United States Patent [19]

Mulcahy et al.

[11] Patent Number: 4,819,345

[45] Date of Patent: Apr. 11, 1989

[54] WATERPROOF SHOE CONSTRUCTION AND MANUFACTURE

[75] Inventors: John J. Mulcahy, Rochester, N.H.; I. David Hill, Milwaukee, Wis.

[73] Assignees: Starensier, Inc., Newburyport, Mass.; Enka America Inc., Asheville, N.C.

[21] Appl. No.: 161,885

[22] Filed: Feb. 29, 1988

[51] Int. Cl.[4] ..... A43B 23/07; A43B 15/00

[52] U.S. Cl. ..... 36/17 R; 36/12; 36/55

[58] Field of Search ..... 36/55, 17 R, 12

[56] References Cited

U.S. PATENT DOCUMENTS

| | | | |
|---|---|---|---|
| 2,883,316 | 4/1959 | Leahy et al. | 36/55 |
| 3,350,795 | 11/1967 | Schoecht | 36/55 |
| 4,493,870 | 1/1985 | Vrouenraets et al. | 428/913 |
| 4,599,810 | 7/1986 | Sacre | 36/55 |

FOREIGN PATENT DOCUMENTS

| | | | |
|---|---|---|---|
| 564271 | 2/1958 | Belgium | 36/17 R |
| 0110627 | 6/1984 | European Pat. Off. . | |
| 2737756 | 3/1979 | Fed. Rep. of Germany . | |
| 3628913 | 3/1988 | Fed. Rep. of Germany | 36/55 |
| 1133363 | 3/1957 | France | 36/17 R |
| 797746 | 7/1958 | United Kingdom | 36/17 R |

OTHER PUBLICATIONS

Recreational Equipment Catalogue, 1980, 36/55 pp. 28, "Gore-Tex Hiking Boot".

*Primary Examiner*—Steven N. Meyers
*Attorney, Agent, or Firm*—Louis A. Morris

[57] ABSTRACT

A waterproof shoe construction and its method of manufacture is disclosed. The shoe has a liner which is impervious to liquid water but pervious to water vapor, a first innersole and a second innersole with a rib. There is a film impervious to liquid water but pervious to water vapor cemented between the first and second innersoles. A horizontal stitch connects the shoe side panels and the rib of the second innersole between the walls of a channel-shaped welt top, which welt bottom is cemented to the top of an outersole. The method of manufacture is a special blend of stitch down and cement construction techniques which allows for a comfortable, waterproof shoe at a lower manufacturing cost.

6 Claims, 1 Drawing Sheet

WATERPROOF SHOE CONSTRUCTION AND MANUFACTURE

BACKGROUND OF THE INVENTION

This invention relates to new and useful improvements in waterproof shoe construction. The invention utilizes recently-developed liner materials which are impervious to liquid water but pervious to water vapor, allowing for dry and comfortable shoes and boots. In our manufacture, no separate "bootie" insert is required; still, the waterproof lining is not perforated by stitches. The result from our special blend of manufacturing techniques is an economical, sturdy shoe construction.

DESCRIPTION OF THE PRIOR ART

U.S. Pat. No. 3,350,795 discloses a one-piece shoe upper and sole liner connected to the upper by lines of stitching extending only across the base of the tonque above the instep and about the ankle opening.

West German Patent Application No. 27 37 756 discloses waterproof, breathable laminate textiles incorporating microporous polytetrafluoroethylene membranes.

European Patent Application No. 0110627 discloses a waterproof, breathable, stretchable sock incorporating microporous polytetrafluoroethylene membranes. The sock is adaptable as a "bootie" insert waterproof lining for a shoe.

U.S. Pat. No. 4,493,870 discloses waterproof, breathable laminate textiles incorporating a film of a copolyether ester consisting of random long-chain and short-chain ester units.

U.S. Pat. No. 4,599,810 discloses a shoe having a waterproof shoe liner in the shape of a sock attached to the top portion of the shoe upper. The figures of this patent, particularly FIG. 13, show shoe construction including (1) an upper section with side panel portions, and a top opening arranged to receive a foot; (2) a liner, impervious to water but pervious to perspiration vapors, connected to the top inside of the upper section and having a folded-over flange portion on its lower end; (3) a first innersole attached by adhesive on its bottom peripheral side to the top side of the folded-over flange portion of the liner; (4) a second innersole having a rib extending down from its bottom periphery and cemented on its top periphery to the bottom side of the folded-over flange portion of (2) above; a question mark shaped welt with the open side of its curved part facing down and connected to the lower end of the upper section side panel portions and the rib of the second innersole by a horizontal stitch passing through the side panel portions, the rib and one place in the welt near the end of the curve portion opposite the straight leg of the question mark shape, with the welt secured by a vertical stitch near the end of its straight leg to a midsole.

SUMMARY OF THE INVENTION

What we disclose is:

A waterproof shoe construction comprising:

(a) an upper section with side panel portions, and a top opening arranged to receive a foot;

(b) a liner connected to the top inside of said upper section, said liner being impervious to liquid water, but pervious to water vapor, said liner with a folded-over flange portion on its lower end;

(c) a first innersole cemented on its bottom peripheral side to the top side of said folded-over flange portion of said liner;

(d) a second innersole, with a rib extending down from its bottom peripherial side;

(e) a film impervious to liquid water but pervious to water vapor, cemented on its top side to the bottom side of the first innersole and overlapping the entire periphery of the folded over flange portion, and cemented on its bottom side to the top side of the second innersole;

(f) a channel-shaped welt with its open end facing upwards for receiving the lower end of the upper section side panel portions and the rib extending down from the second innersole, said welt being connected to the side panel portions and the rib by a substantially horizontal stitch passing through both walls of the welt, the side panel portions and the rib; and, (g) and outersole cemented on its top peripheral side to the flat bottom end of said channel-shaped welt.

Also, we disclose

A method for making a waterproof shoe which comprises:

(a) connecting a liner, impervious to liquid water, but pervious to water vapor, to the top inside of a shoe upper section;

(b) temporarily connecting a first innersole on its top side to the bottom of a shoe last, and inserting the last with the first innersole into the cavity created by the shoe upper section with the lining;

(c) pulling the liner lower end over the peripheral edge of the last to create a folded-over flange portion, and cementing the top side of the flange portion to the bottom peripheral side of the first innersole;

(d) bonding the top surface of a film, impervious to liquid water, but pervious to water vapor, to the bottom side of said first innersole and the entire periphery of the bottom side of folded-over flange portion, and bonding the bottom surface of said film to the top side of a second innersole which has a rib on its bottom side extending from its periphery;

(e) inserting the lower end of the shoe upper section side panel portions and the rib extending down from the bottom peripheral side of the second innersole into the upward facing open end of a channel-shaped welt and passing a substantially horizontal stitch through both walls of the welt, the side panel portions and the rib;

(g) cementing the flat bottom of the welt to the top peripheral side of an outersole; and (h) removing the last from the shoe through its top opening.

DETAILED DESCRIPTION OF THE PREFERRED EMBODIMENTS

Figure 1:
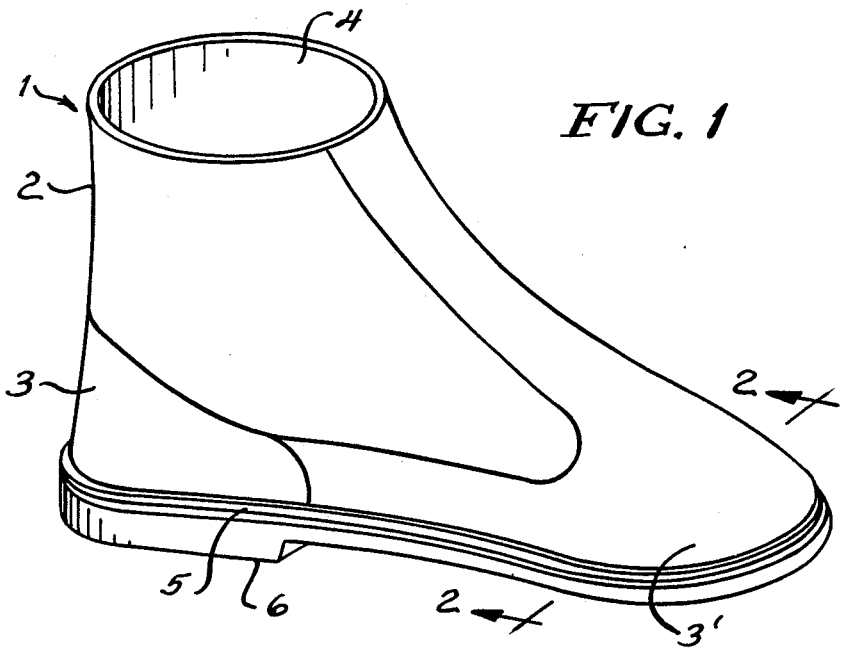
FIG. 1 is a perspective view of a shoe construction embodying our invention.

Referring particularly to FIG. 1, there is shown a shoe construction (1) according to our invention including an upper section (2) with side panel portions (3 & 3') and a top opening (4) to receive a foot. Also there is shown a welt (5) for connecting the upper section side panel portions (3 & 3') to an outersole (6).

Regarding shoe construction (1), it may be a shoe or a boot with laces, hooks, Velcro® or zippers for closures. Upper section (2) may be of natural or synthetic material. Side panel portions (3 & 3') may be the same or different materials.

Welt (5) is the visible outside wall of our special channel-shaped welt described later in more detail. Outersole (6) may comprise one or more other midsoles sewn, stapled or cemented together.

Figure 2:
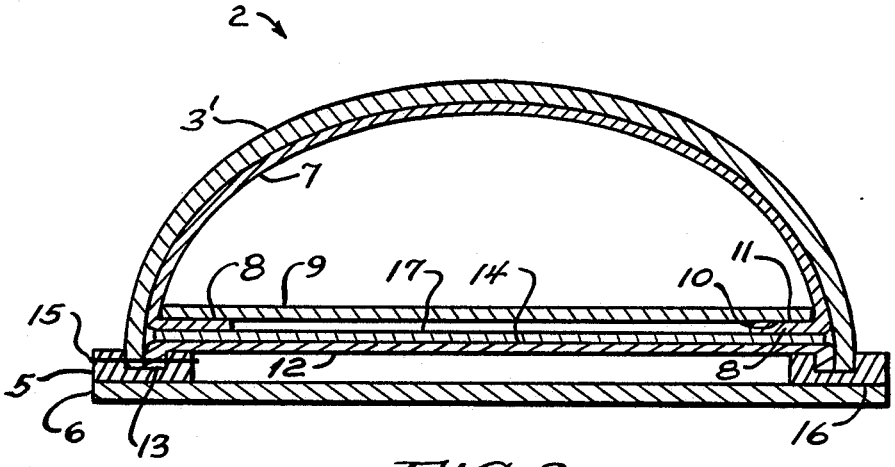
FIG. 2 is an expanded partial sectional view taken on the line 2—2 of FIG. 1 also showing the liner and the first and second innersoles in the shoe.

Referring particularly to FIG. 2, there is shown a liner (7) inside of the upper section (2), said liner (7) being impervious to liquid water, but pervious to water vapor. At its lower end the liner (7) is folded over to create a flange portion (8). A first innersole (9) is cemented on its bottom peripheral side (10) to the top side (11) of the folded-over flange portion (8).

In FIG. 2 there is also shown a second innersole (12) with a rib (13) extending down from its bottom peripheral side. There is a film (17) impervious to liquid water but pervious to water vapor bonded on its top side to the bottom of innersole (9), including the entire periphery of the folded over flange portion (8), and on its bottom side to the top side (14) of the second innersole (12). Channel-shaped welt (5) has its open end facing upwards to receive the lower end of the upper section side panel portions (3 & 3') and the rib (13) extending down from the second innersole (12). The side panel portions (3 & 3') and rib (13) contact each other side-by-side between the walls of welt (5), and they are connected to each other and to the walls of the welt (5) by a substantially horizontal stitch (15) passing through both walls of the welt (5), the side panel portions (3 & 3') and the rib (13).

The flat bottom end (16) of channel-shaped welt (5) is cemented to the top peripheral side of outersole (6). The relatively large and smooth surface area of welt (5) flat bottom end (16) according to our invention provides for a secure connection between the upper section (2) and the outersole (6) of the shoe. Also, not having to down stitch the welt (5) to the outersole (6) according to our invention provides for ease and economy in the manufacture of waterproof shoes.

Regarding liner (7), it may be any waterproof, breathable material. A preferred material is Sympatex®, a proprietary material made by ENKA America, Inc., a member of the AKZO group, and distributed in the United States by Starensier, Inc.; 5 Perkins Way; P.O. Box 408; Newburyport, MA 01950-0508. Sympatex® is a laminate film which may be bonded with adhesive or by heat fusion to any textile material to make the liner (7). Sympatex® has high abrasion resistance and flex tolerance, so shoes made with it wear well and stay waterproof. Sympatex® is described and claimed in U.S. Pat. No. 4,493,870 (expressly incorporated herein by reference) as a waterproof film material of a copolyether ester consisting of a plurality of recurrent intralinear long-chain ester units and short-chain ester units which are randomly joined head-to-tail through ester bonds. The long chain ester units correspond to the formula:

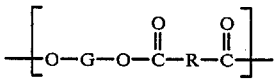

and the short-chain ester units correspond to the formula:

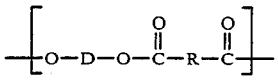

where G is a divlent radical remaining after removal of terminal hydroxyl groups from at least one long-chain glycol having a molecular weight in the range of 800 to 6000 and an atomic ratio of carbon to oxygen in the range of 2.0 to 4.3, at least 70% by weight of the long chain glycol having a carbon to oxygen ratio in the range of 2.0 to 2.4, R is a divalent radical remaining after removal of carboxyl groups from at least one carboxylic acid having a molecular weight less than 300, and D is a divalent radical remaining after removal of hydroxyl groups from at least one diol having a molecular weight less than 250, at least 80 mole % of the dicarboxylic acid used consisting of terephthalic acid or the ester forming equivalents thereof and at least 80 mole % of the low molecular weight diol consisting of 1,4-butanediol or the ester forming equivalents thereof, the sum of the mole percentages of the dicarboxylic acid which is not terephthalic acid or the ester forming equivalents thereof and of the low molecular weight diol which is not 1,4-butanediol of the ester forming equivalents thereof is not higher than 20 and the short-chain ester units form 50–75% by weight of the copolyether ester.

To make our waterproof shoe, one must connect the liner (7) to the top inside of the shoe upper section (2) by cementing or stitching. The liner (7) should be the same size as the upper section (2). Separately, temporarily connect a first innersole (9) on its top side to the bottom of a standard shoe last, and insert the last with the first innersole (9) into the cavity created by the upper section (2) with the lining (7). Then, by conventional cement lasting, pull the liner (7) lower end over the peripheral edge of the last to create a folded-over flange portion (8), and cement the top side (11) of the flange portion (8) to the bottom peripheral side (10) of the first innersole (9).

Separately, bond a film (17), impervious to liquid water but pervious to water vapor, either onto the top side (14) of the second innersole (12) opposite from the side with the rib (14) extending from its periphery or onto the bottom of the entire periphery of flanged portion (8). The waterproof film, if it is Sympatex®, may be bonded to the second innersole (12), the bottom of flanged portion (8) and, optionally, also the bottom of first innersole (9) with adhesive or by heat fusion. A suitable adhesive is neoprene cement. Heat fusion may be done in a heat press when the Sympatex® film is supplied with a heat activated fusible coating. A temperature of about 160 F. and a pressure about 40 psi for about 5 seconds is enough to fuse the Sympatex® to the second innersole (12) and to any other fabric. The film (17) is cut roughly to the shape of innersole (9) with size sufficient to overlap the entire periphery of flanged portion (8). If film (17) is not bonded or cemented to the bottom of first innersole (9), it might be desirable to place a shank or other filler materials in the space between the first and second innersoles.

Then, bond the innersole not yet bonded with film (17) to the then unbonded side of film (17). The second innersole (12) is now bonded via film (17) to the waterproof liner (7), providing a complete, waterproof enclosure for the foot in shoe construction (1).

Next, welt the lower end of the shoe upper section side panel portions (3 & 3') together with the rib (13) extending down from the bottom peripheral side of the second innersole (12). With our special and unique channel-shaped welt (5), this welting is accomplished by passing a substantially horizontal stitch (15) through both walls of the upwardly-open channel welt (5), the side panel portions (3 & 3') and the rib (13). Stitch (15) may, in some welting machines, be a staple (15) instead.

Finally, cement the flat bottom (16) of the welt (5) to the top peripheral side of the outersole (6), and remove the last from the shoe through its top opening (4). This method provides a completely waterproof, sturdy and economical shoe construction.

Compared to the prior art, our waterproof shoe has several distinct differences and advantages. First, our invention does not require the "bootie" insert, or liner with an integral bottom portion, as disclosed in U.S. Pat. No. 3,350,795 and European Patent Application No. 0110627. Second, our special, channel-shaped welt (5) is double-stitched through both walls around the side panel portions (3 & 3') and the rib (13) of second innersole (12). This feature provides for a simple and secure connection between the shoe upper section (2) and the liner (7) and innersoles (9) and (12). Third, our special blended manufacturing process, cement, then stitchdown and then cement again, allows elimination of the second vertical stitch required in the Norwegian and Goodyear welts and the construction described in FIGS. 10–13 of U.S. Pat. No. 4,599,810. Instead, in our process and construction we utilize the large, flat bottom end (16) of channel-shaped welt (5) to provide a secure cement bond between the upper section (2) and the outersole (6).

With further regard to the shoe construction taught in U.S. Pat. No. 4,599,810 compared to that of the present invention, it is particularly important to note differences including the film (17) impervious to liquid water but pervious to water vapor between innersoles (9) and (12) of the latter, but lacking in the former, and the U-shaped welt of the latter which is pierced and thus secured in two places by the horizontal stitch through the rib of innersole (12) and side panel portions (3 & 3') as compared to the question mark shaped welt of the former which is pierced and secured to the rib and side panel portions only at one location. These differences are not inconsequential since they provide to the present invention complete waterproof sealing and double the strength by which the welt is secured to the innersole and side panels of the shoe as compared to the teachings of U.S. Pat. No. 4,599,810.

What we claim is:

1. A waterproof shoe construction (1) comprising:
(a) an upper section (2) with side panel portions (3 & 3'), and a top opening (4) arranged to receive a foot;
(b) a liner (7) connected to the inside of said upper section (2), said liner (7) being impervious to liquid water, but pervious to water vapor, said liner (7) with a folded-over flange portion (8) on its lower end;
(c) a first innersole (9) cemented on its bottom peripheral side (10) to the top side (11) of said folded-over flange portion (8) of said liner (7);
(d) a second innersole (12), with rib (13) extending down from its bottom peripheral side;
(e) a film (17) impervious to liquid but pervious to water vapor overlapping the entire periphery of said folded over flange portion (8), and bonded on its top side thereto and bonded on its bottom side to the top side of said second innersole (12);
(f) a channel-shaped welt (5) with its open end facing upwards for receiving the lower end of the upper section side panel portions (3 & 3') and the rib (13) extending down from the second innersole (12), said welt (5) being connected to the side panel portions (3 & 3') and the rib (13) by a substantially horizontal stitch (15) passing through both walls of the welt (5), the side panel portions (3 & 3') and the rib (13); and,
(g) an outersole (6) cemented on its top peripheral side to the flat bottom end (16) of said channel-shaped welt (5).

2. The shoe construction of claim 1 wherein the liner (7) is a laminate of a textile material and Sympatex® waterproof film.

3. The shoe construction of claim 1 wherein said film (17) comprises Sympatex® waterproof film.

4. A method for making a waterproof shoe (1) which comprises:
(a) connecting a liner (7), impervious to liquid water, but pervious to water vapor, to the top inside of a shoe upper section (2);
(b) temporarily connecting a first innersole (9) on its top side to the bottom of a shoe last, and inserting the last with the first innersole (9) into the cavity created by the shoe upper section (2) with the lining (7);
(c) pulling the liner lower end over the peripheral edge of the last to create a folded-over flange portion (8), and cementing the top side of the flange portion (8) to the bottom peripheral side (10) of the first innersole (9);
(d) bonding the top surface of a film (17), impervious to liquid water, but pervious to water vapor, to the entire periphery of the bottom side of folded over flange portion (8), and bonding the bottom surface of said film (17) to the top side of a second innersole (12) which has a rib (13) on its bottom side extending from its periphery;
(e) inserting the lower end of the shoe upper section side panel portions (3 & 3') and the rib (13) extending down from the bottom peripheral side of the second innersole (12) into the upward facing open end of a channel-shaped welt (5) and passing a substantially horizontal stitch (15) passing through both walls of the welt (5), the side panel portions (3 & 3') and the rib (13);
(f) cementing the flat bottom (16) of the welt (5) to the top peripheral side of an outersole (6); and
(g) removing the last from the shoe through its top opening (4).

5. The method of claim 4 wherein the liner (7) is a laminate of a textile material and Sympatex® waterproof film.

6. The method of claim 4 wherein said film (17) comprises Sympatex® waterproof film.

* * * * *